US010264894B2

(12) United States Patent
Gibbons

(10) Patent No.: US 10,264,894 B2
(45) Date of Patent: Apr. 23, 2019

(54) BABY CARRIER SYSTEM

(71) Applicant: The Boppy Company, LLC, Golden, CO (US)

(72) Inventor: Haley Gibbons, Westminster, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

(21) Appl. No.: 15/430,230

(22) Filed: Feb. 10, 2017

(65) Prior Publication Data

US 2018/0228299 A1 Aug. 16, 2018

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02; A61G 1/00
USPC ..... 224/160
See application file for complete search history.

(56) References Cited

U.S. PATENT DOCUMENTS 3,871,562 A * 3/1975 Grenier ..... A47D 13/025 224/160
4,009,808 A * 3/1977 Sharp ..... A47D 13/025 224/160
4,166,558 A 9/1979 Schroeder
4,428,514 A * 1/1984 Elf ..... A47D 13/025 224/155
4,434,920 A * 3/1984 Moore ..... A47D 13/025 224/160
4,469,259 A * 9/1984 Krich ..... A47D 13/025 224/159
4,492,326 A * 1/1985 Storm ..... A47D 13/025 224/159
4,986,458 A * 1/1991 Linday ..... A47D 13/025 224/160
5,071,047 A * 12/1991 Cordisco ..... A47D 13/025 224/158
5,205,451 A 4/1993 Manzer
(Continued)

FOREIGN PATENT DOCUMENTS

AU 2008249011 A1 11/2008
CA 2685364 C 12/2014
(Continued)

OTHER PUBLICATIONS

International Search Report and Written Opinion dated May 28, 2018 in related application PCT/US2018/014075, all pages.
(Continued)

*Primary Examiner* — Brian D Nash
(74) *Attorney, Agent, or Firm* — Kilpatrick Townsend & Stockton LLP

(57) ABSTRACT

A baby carrier capable of carrying an infant. The baby carrier includes a belt that wraps around a caregiver's waist. A baby support portion couples to the belt and supports the infant. A first loop of fabric couples to the baby support portion. The first loop of fabric couples the baby support portion to a caregiver's shoulder. A second loop of fabric couples to the baby support portion. The second loop of fabric couples the baby support portion to the caregiver's opposite shoulder. First and second straps of fabric couple to the respective first and second loops enabling adjustment and securing of the baby carrier to the caregiver.

13 Claims, 10 Drawing Sheets

(56) References Cited

U.S. PATENT DOCUMENTS 5,246,152 A 9/1993 Dotseth
5,490,620 A 2/1996 Bergqvist
5,632,425 A 5/1997 Hull
5,678,739 A 10/1997 Darling et al.
5,692,655 A * 12/1997 Fair ..... A47D 13/025 224/160
5,791,535 A * 8/1998 Roan ..... A47D 13/025 224/153
5,813,580 A * 9/1998 Fair ..... A47D 13/025 224/160
5,848,741 A * 12/1998 Fair ..... A47C 7/66 224/160
5,961,014 A 10/1999 Knerr
6,045,018 A 4/2000 Onishi
6,257,468 B1 7/2001 Yamazoe et al.
D452,993 S * 1/2002 Norman ..... D3/213
6,409,060 B2 * 6/2002 Donine ..... A47D 13/025 224/160
6,443,339 B1 9/2002 Higuchi
6,598,771 B2 * 7/2003 Norman ..... A47D 13/025 224/160
6,666,361 B1 12/2003 Lin
D486,635 S * 2/2004 Yagisawa ..... D3/213
6,808,099 B2 10/2004 Nykoluk
6,988,644 B1 1/2006 Asherbranner
7,004,362 B2 2/2006 Boone
7,070,076 B2 7/2006 Bergkvist
7,252,214 B2 8/2007 Krogh
7,287,676 B2 * 10/2007 Chua ..... A41B 13/06 2/69
7,322,498 B2 * 1/2008 Frost ..... A47D 13/025 224/155
7,494,031 B2 2/2009 Kassai et al.
7,661,566 B2 2/2010 Yoshie et al.
D614,861 S 5/2010 Smyth et al.
7,766,199 B1 8/2010 Caperon
7,886,946 B2 * 2/2011 Gray ..... A47D 15/006 224/158
D642,375 S 8/2011 Zack et al.
D649,345 S * 11/2011 Bergkvist ..... D3/214
8,056,779 B1 * 11/2011 Brunwin ..... A47D 13/025 224/160
D657,132 S 4/2012 Caperon
8,172,116 B1 5/2012 Lehan et al.
D672,546 S 12/2012 Dror et al.
8,393,505 B2 3/2013 Coote et al.
8,403,193 B2 3/2013 Chan
8,418,897 B1 4/2013 Young
8,424,732 B1 4/2013 Lehan et al.
8,453,894 B2 6/2013 Jung et al.
8,453,897 B2 6/2013 Burton
8,464,920 B2 6/2013 Meyer
8,490,844 B2 7/2013 Favorito et al.
8,523,028 B1 9/2013 Young
D691,791 S 10/2013 Rondone
8,579,168 B2 11/2013 Zack
8,590,757 B2 11/2013 Frost
8,701,949 B1 4/2014 Lehan et al.
8,752,739 B2 * 6/2014 Bergkvist ..... A47D 13/025 224/158
8,807,411 B2 8/2014 Meyer
8,925,772 B2 * 1/2015 Vukovics ..... A47D 13/025 224/160
8,973,793 B2 * 3/2015 Arvan ..... A47D 13/02 224/158
8,973,794 B2 * 3/2015 Bergkvist ..... A47D 13/025 224/159
9,022,260 B2 5/2015 Frost
D738,614 S 9/2015 Chapman
D738,615 S 9/2015 Chapman
9,119,423 B2 9/2015 Gotel et al.
9,138,071 B2 9/2015 Larch
9,173,473 B2 11/2015 Gleason
9,179,758 B2 11/2015 Calilung et al.
9,185,993 B2 11/2015 Telford et al.
9,198,525 B2 12/2015 Wernick et al.
9,220,352 B2 12/2015 Frost
9,277,830 B2 3/2016 Schachtner
D752,855 S 4/2016 Halverstadt et al.
9,314,111 B2 4/2016 Hartwell et al.
9,314,112 B2 4/2016 Chuah et al.
9,314,113 B1 4/2016 Lehan et al.
9,357,852 B2 6/2016 Salazar et al.
9,375,096 B2 6/2016 Larch
9,380,886 B2 7/2016 Rahni
9,380,887 B2 7/2016 Frost
9,380,888 B2 7/2016 Telford et al.
9,386,863 B1 7/2016 Antunovic
9,439,515 B2 9/2016 Kim
9,521,912 B2 12/2016 Yen
9,565,951 B2 2/2017 Schaarschmidt
9,629,398 B2 4/2017 Goryl
9,681,737 B2 6/2017 Gleason
9,700,152 B2 7/2017 Telford et al.
9,713,391 B2 7/2017 Telford et al.
9,750,352 B2 9/2017 Harris
9,750,353 B2 9/2017 Antunovic
9,788,664 B2 10/2017 Andren et al.
9,839,302 B2 12/2017 Frost
9,848,713 B2 12/2017 Rosen et al.
9,877,596 B2 1/2018 Schaarschmidt
9,949,575 B2 * 4/2018 Pond ..... A47D 13/025
9,955,797 B2 5/2018 Telford et al.
10,045,634 B2 * 8/2018 Salazar ..... A47D 13/025
10,172,478 B2 * 1/2019 Telford ..... A47D 13/025
2003/0178452 A1 * 9/2003 Norman ..... A47D 13/025 224/160
2005/0242136 A1 11/2005 Moriguchi et al.
2005/0279785 A1 12/2005 Liistro et al.
2007/0029356 A1 2/2007 Moriguchi et al.
2007/0080183 A1 4/2007 Lafoux et al.
2007/0284403 A1 12/2007 Minami et al.
2008/0283559 A1 11/2008 Parness et al.
2010/0147910 A1 6/2010 Schachtner
2010/0200626 A1 8/2010 Moftakhar
2011/0101051 A1 5/2011 Parness et al.
2011/0240693 A1 10/2011 Parness et al.
2012/0152987 A1 6/2012 Beltrame et al.
2012/0199619 A1 8/2012 Zack
2012/0234877 A1 9/2012 Hiniduma-Lokuge
2012/0241487 A1 9/2012 Zack et al.
2012/0266350 A1 10/2012 Zack
2012/0286002 A1 11/2012 Dardel et al.
2014/0084031 A1 3/2014 Bowden
2014/0231473 A1 8/2014 Bailey et al.
2014/0263492 A1 9/2014 Bailey et al.
2014/0284362 A1 9/2014 Halverstadt et al.
2014/0319189 A1 10/2014 Hoppener-Visser
2015/0196133 A1 7/2015 Rosen et al.
2015/0201761 A1 7/2015 Wollenberg
2015/0272342 A1 10/2015 Schaarschmidt
2016/0066704 A1 3/2016 Frost
2016/0120334 A1 5/2016 Pond et al.
2016/0150893 A1 6/2016 Salazar et al.
2016/0198865 A1 7/2016 Houston
2016/0206011 A1 7/2016 Houston
2016/0227940 A1 8/2016 Wikner et al.
2016/0278537 A1 9/2016 Frost
2017/0119173 A1 5/2017 Telford
2017/0135497 A1 5/2017 Brodin
2017/0150826 A1 6/2017 Salazar et al.
2017/0196374 A1 7/2017 Chen
2017/0238682 A1 8/2017 Goryl
2017/0238722 A1 8/2017 Flaunty et al.
2017/0251829 A1 9/2017 Telford et al.
2017/0332806 A1 11/2017 Liu
2017/0332807 A1 11/2017 Liu
2018/0116426 A1 5/2018 Telford

FOREIGN PATENT DOCUMENTS

DE 112010003056 B4 8/2018
EP 1765123 B1 6/2011

(56) References Cited

FOREIGN PATENT DOCUMENTS

| | | | |
|---|---|---|---|
| EP | 2470050 | B1 | 3/2014 |
| ES | 2540812 | T3 | 7/2015 |
| GB | 2297915 | A | 8/1996 |
| WO | 2005025383 | A2 | 6/2005 |
| WO | 2013188810 | A1 | 12/2013 |
| WO | 2014160355 | A1 | 11/2014 |
| WO | 2016161111 | A1 | 10/2016 |
| WO | 2016164713 | A1 | 10/2016 |
| WO | 2017075500 | A1 | 5/2017 |
| WO | 2018033351 | A1 | 2/2018 |
| WO | 2018081603 | A1 | 5/2018 |

OTHER PUBLICATIONS

Schachtner, Petra, "Baby and Toddler Carrier", OHIM—Office for Harmonization in the Internal Market, No. 000989736-0001, Aug. 21, 2008, all pages.
Schachtner, Petra, "Baby and Toddler Carrier", OHIM—Office for Harmonization in the Internal Market, No. 000989736-0002, Aug. 21, 2008, all pages.
Schachtner, Petra, "Baby and Toddler Carrier", OHIM—Office for Harmonization in the Internal Market, No. 000989736-0003, Aug. 21, 2008, all pages.
Schachtner, Petra, "Baby and Toddler Carrier", OHIM—Office for Harmonization in the Internal Market, No. 000989736-0004, Aug. 21, 2008, all pages.
Schachtner, Petra, "Baby and Toddler Carrier", OHIM—Office for Harmonization in the Internal Market, No. 000989736-0005, Aug. 21, 2008, all pages.
Schachtner, Petra, "Baby and Toddler Carrier", OHIM—Office for Harmonization in the Internal Market, No. 000989736-0006, Aug. 21, 2008, all pages.
Schachtner, Petra, "Baby and Toddler Carrier", OHIM—Office for Harmonization in the Internal Market, No. 000989736-0007, Aug. 21, 2008, all pages.
Schachtner, Petra, "Baby and Toddler Carrier", OHIM—Office for Harmonization in the Internal Market, No. 000989736-0008, Aug. 21, 2008, all pages.
Schachtner, Petra, "Baby and Toddler Carrier", OHIM—Office for Harmonization in the Internal Market, No. 000989736-0009, Aug. 21, 2008, all pages.
Schachtner, Petra, "Baby and Toddler Carrier", OHIM—Office for Harmonization in the Internal Market, No. 000989736-0010, Aug. 21, 2008, all pages.
Schachtner, Petra, "Baby and Toddler Carrier", OHIM—Office for Harmonization in the Internal Market, No. 000989736-0011, Aug. 21, 2008, all pages.
Schachtner, Petra, "Baby and Toddler Carrier", OHIM—Office for Harmonization in the Internal Market, No. 000989736-0012, Aug. 21, 2008, all pages.
Schachtner, Petra, "Baby and Toddler Carrier", OHIM—Office for Harmonization in the Internal Market, No. 000989736-0013, Aug. 21, 2008, all pages.
Schachtner, Petra, "Baby and Toddler Carrier", OHIM—Office for Harmonization in the Internal Market, No. 000989736-0014, Aug. 21, 2008, all pages.
Schachtner, Petra, "Baby and Toddler Carrier", OHIM—Office for Harmonization in the Internal Market, No. 000989736-0015, Aug. 21, 2008, all pages.
Schachtner, Petra, "Baby and Toddler Carrier", OHIM—Office for Harmonization in the Internal Market, No. 000989736-0016, Aug. 21, 2008, all pages.
Schachtner, Petra, "Baby and Toddler Carrier", OHIM—Office for Harmonization in the Internal Market, No. 000989736-0017, Aug. 21, 2008, all pages.
Schachtner, Petra, "Baby and Toddler Carrier", OHIM—Office for Harmonization in the Internal Market, No. 000989736-0018, Aug. 21, 2008, all pages.
Schachtner, Petra, "Baby and Toddler Carrier", OHIM—Office for Harmonization in the Internal Market, No. 000989736-0019, Aug. 21, 2008, all pages.
Schachtner, Petra, "Baby and Toddler Carrier", OHIM—Office for Harmonization in the Internal Market, No. 000989736-0020, Aug. 21, 2008, all pages.
Schachtner, Petra, "Baby and Toddler Carrier", OHIM—Office for Harmonization in the Internal Market, No. 000989736-0021, Aug. 21, 2008, all pages.
Schachtner, Petra, "Baby and Toddler Carrier", OHIM—Office for Harmonization in the Internal Market, No. 000989736-0022, Aug. 21, 2008, all pages.
Schachtner, Petra, "Baby and Toddler Carrier", OHIM—Office for Harmonization in the Internal Market, No. 000989736-0023, Aug. 21, 2008, all pages.
Schachtner, Petra, "Baby and Toddler Carrier", OHIM—Office for Harmonization in the Internal Market, No. 000989736-0024, Aug. 21, 2008, all pages.
Unknown, Design DE700000040011804-0001, Dec. 27, 2006, all pages.
Bobby, Power Point, uploaded Jan. 1, 2018, 3 pages.
Schotthofer, Peter, "Sling for carrying babies", Office for Harmonization in the Internal Market, No. 000304514-0001, Mar. 5, 2005, all pages.
Schotthofer, Peter, "Sling for carrying babies", Office for Harmonization in the Internal Market, No. 000304514-0002, Mar. 5, 2005, all pages.

* cited by examiner

10

BABY CARRIER SYSTEM

FIELD OF THE INVENTION

The disclosure generally relates to baby carriers.

BACKGROUND OF THE INVENTION

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Babies and toddlers are frequently carried by their mothers and other caregivers before they are able to comfortably walk on their own. Carrying babies enables a caregiver to better monitor and comfort their babies. Unfortunately, carrying a baby around reduces the caregiver's ability to perform other tasks such as shopping and caring for other small children because one or more hands/arms are used to carry the infant. A baby may also exhaust a caregiver when carried for a long time. Baby carriers enable caregivers to carry babies using their torso and shoulders, which frees their hands to perform other tasks. However, existing baby carriers can be difficult to assemble and to adjust. For example, some carriers consist of a single piece of fabric that a caregiver wraps in a complicated manner to secure the infant. Other baby carriers have an excessive number of straps and buckles that need to be individually adjusted for comfort and to secure the infant:

BRIEF SUMMARY OF THE INVENTION

The embodiments discussed below include a baby carrier capable of carrying an infant. The baby carrier includes a belt that wraps around a caregiver's waist. A baby support portion couples to the belt and supports the infant. A first loop of fabric couples to the baby support portion. The first loop of fabric couples the baby support portion to a caregiver's shoulder. A second loop of fabric couples to the baby support portion. The second loop of fabric couples the baby support portion to the caregiver's opposite shoulder. First and second straps of fabric couple to the respective first and second loops enabling adjustment and securing of the baby carrier to the caregiver.

In another embodiment, the baby carrier includes a belt that wraps around the caregiver's waist. A baby support portion couples to the belt. A first loop of fabric rests on a caregiver's first shoulder. The first loop of fabric has a first loop end and a second loop end. The first loop end and the second loop end couple to the baby support portion. A second loop of fabric rests on a caregiver's second shoulder. The second loop of fabric has a first loop end and a second loop end. The first loop end and the second loop end of the second loop couple to the baby support portion.

In another embodiment, a method of carrying a baby in a baby carrier. The method includes coupling a belt of the baby carrier around a caregiver's waist. After coupling the belt to the caregiver, the caregiver places a baby in a baby support portion. The caregiver secures the baby in the baby carrier by placing a caregiver's left arm through a first loop and a right arm through a second loop. To adjust the baby carrier, the caregiver may pull first and second straps coupled to the respective first and second loops. The caregiver may then secure the baby carrier in the adjusted position by tying a knot with the first and second straps.

BRIEF DESCRIPTION OF THE DRAWINGS

Various features, aspects, and advantages of the present invention will be better understood when the following detailed description is read with reference to the accompanying figures in which like characters represent like parts throughout the figures, wherein.

DETAILED DESCRIPTION OF THE INVENTION

One or more specific embodiments of the present invention will be described below. These embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The discussion below describes embodiments of a baby carrier that is comfortable, aesthetically pleasing, and easy to assemble. The term baby is understood to mean a child up to approximately three years of age and weighing up to approximately thirty-five pounds. The baby carrier includes a belt for coupling the baby carrier to a caregiver. The belt in turn couples to a baby support portion that receives the infant. The baby carrier includes two loops that couple to the caregiver to further support and secure the infant. In some embodiments, the baby carrier may include straps coupled to the loops that enable adjustment of the baby carrier (e.g., lift the infant, pull the baby closer to the caregiver). These adjustment straps may also secure the loops to the caregiver's shoulders when tied in a knot around the caregiver.

Figure 1:
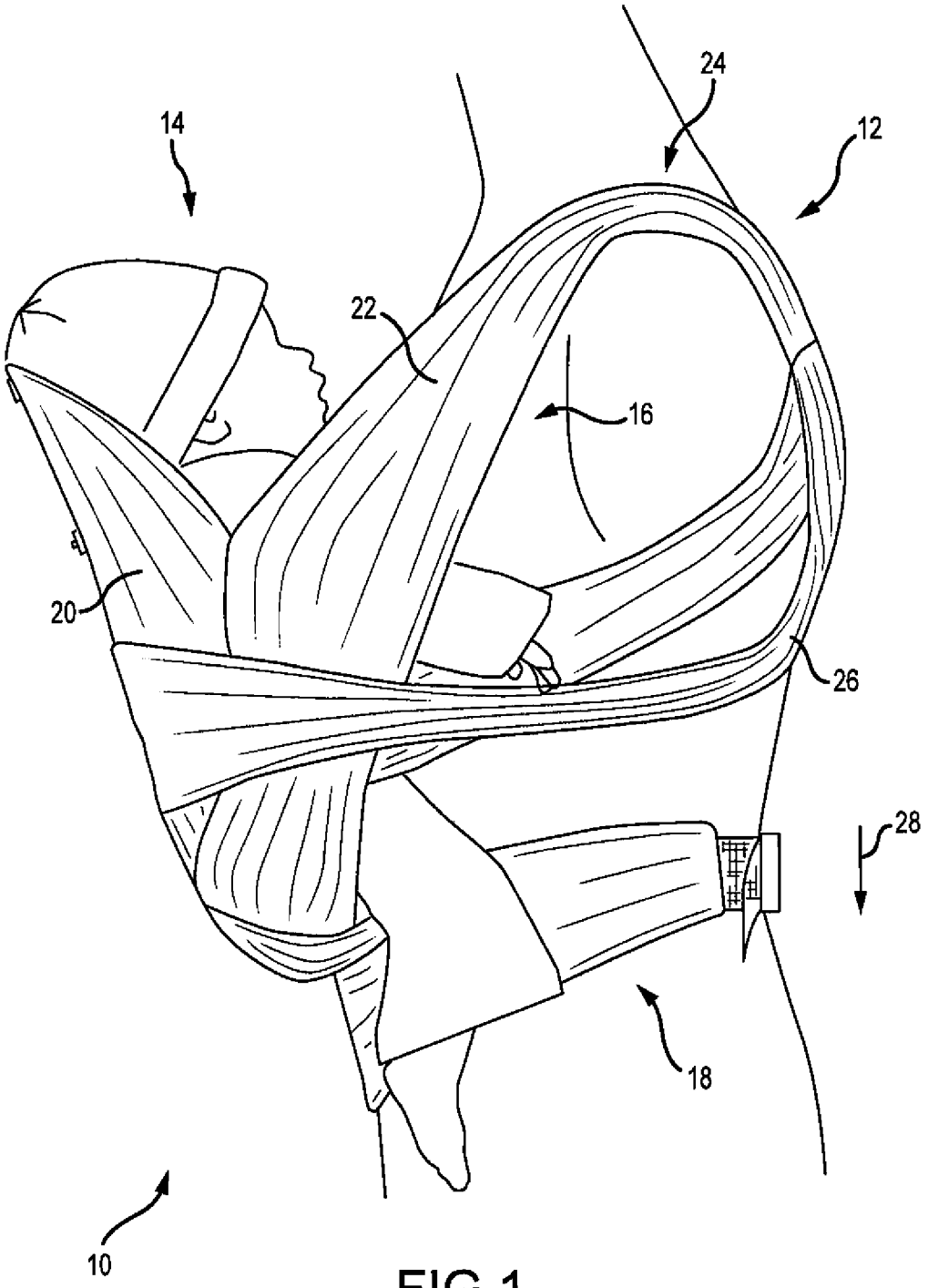
FIG. 1 is a side view of an embodiment of a baby carrier supporting an infant.

FIG. 1 is a side view of an embodiment of a baby carrier 10 worn by a caregiver 12 to support a baby 14. As illustrated, the baby carrier 10 places the baby 14 next to the caregiver's chest 16. The close proximity between the baby 14 and the caregiver's chest 16 may naturally soothe and comfort the baby 14. This position also enables the caregiver 16 to observe and comfort the baby 14 (e.g., feed, touch).

The baby carrier 10 includes several pieces that both support the baby 10 and facilitate wearing of the baby carrier 10. The baby carrier 10 includes a belt 18 that provides a first point of contact with the caregiver 12 and carries some of the infant's weight. Attached to the belt is a baby support portion 20 that supports the baby 20. The baby carrier 10 provides further load bearing support by including fabric loops 20. The baby carrier 10 includes two fabric loops 22, one for each shoulder 24. The fabric loops 22 couple to the baby support portion 20 and when worn over the shoulders 24 support and hold the baby 14 close to the caregiver's chest 16. In some embodiments, the baby carrier 10 may include straps 26 that attach to the loops 22. The straps 26 enable the caregiver 12 to adjust the position of the baby 14 as well as secure the loops 22 on the shoulders 24. For example, the straps 26 may enable the caregiver 12 to lift and bring the baby 14 closer to their chest 16. To adjust the infant's position, the caregiver 12 pulls down on the straps 26 in direction 28. As the straps 26 move in direction 28, they pull and rotate the loops 22 around the shoulders 24. The loops 22 in turn lift the baby 14 and pull the baby support portion 20 closer to the chest 16. This new position may then be secured by tying the straps 26 together around the caregiver 12.

Figure 2:
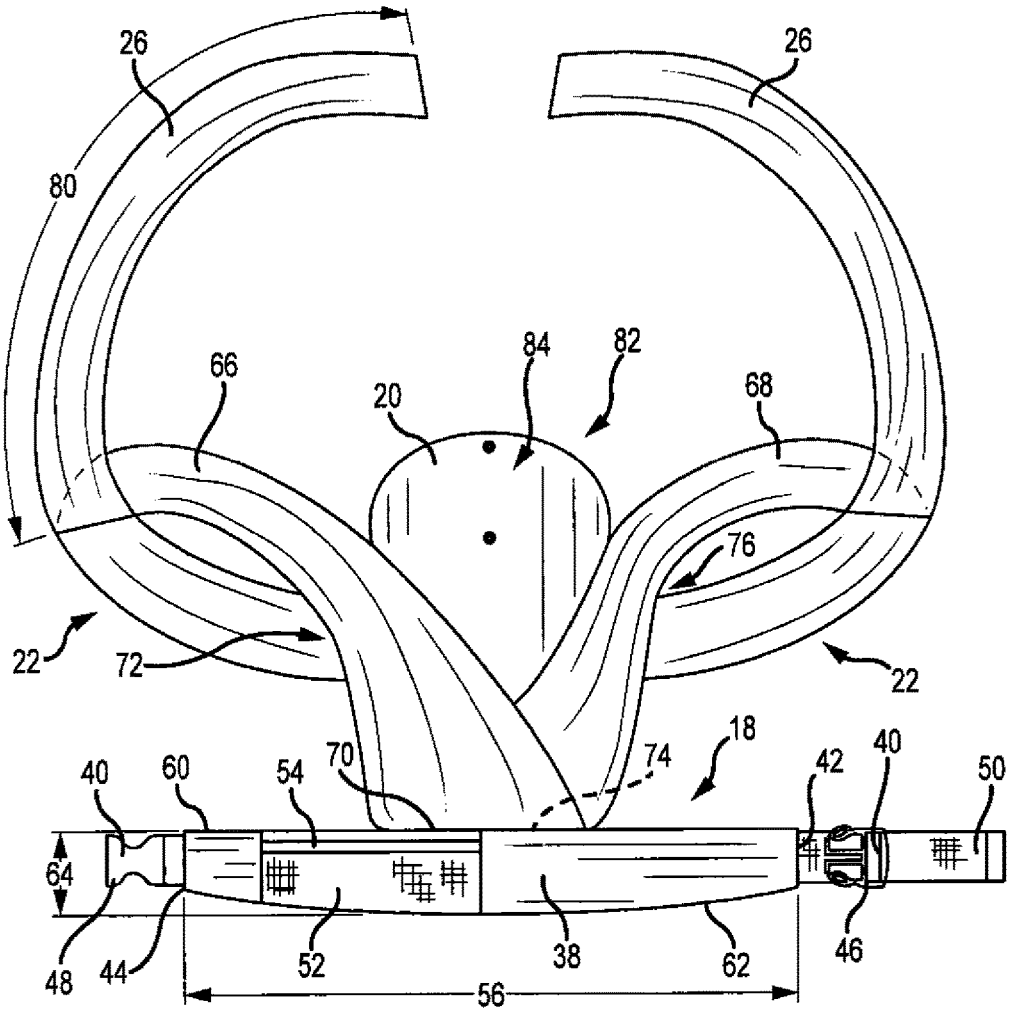
FIG. 2 is a front view of an embodiment of a baby carrier.

FIG. 2 is a front view of an embodiment of the baby carrier 10. As explained above, the baby carrier 10 includes the belt 18 that couples to the baby support portion 20. In some embodiments, the belt 18 includes a belt portion 38 and a buckle system 40 that couples together first and second opposing ends 42, 44 of the belt portion 38. In some embodiments, the buckle system 40 may be a snap-fit buckle system with a male connector 46 and a female connector 48. In other embodiments, the buckle system 40 may be D-rings, snaps, hook and loop fastener, etc. In still other embodiments, the buckle system 40 may be fabric that the caregiver 12 ties together to secure the belt 18.

In FIG. 2, the buckle system 40 is adjustable to accommodate differently sized caregivers. For example, the buckle system 40 may include an adjustable strap 50 that can lengthen or shorten the distance between the male connector 46 and the end 42 of the belt portion. In another embodiment, the female connector 48 may couple to an adjustable strap 50 that enables the female connector 48 to change distance between the belt portion 38 and the second end 44 of the belt portion 38. In still other embodiments, both the male and female connectors 46, 48 may couple to respective adjustable straps 50 to enable size adjustment of the belt 18.

The belt 18 may include one or more pockets 52 for storing various items (e.g., keys, snacks, wallet, ID, etc.). The pocket 52 may open and close with a zipper 54. In other embodiments, the caregiver 12 may secure the contents of the pocket 52 with a button; hook and loop fastener; etc. The pocket 52 extends over a section of the belt portion 38, but in some embodiments, the pocket 52 may extend over the entire length 56 of the belt portion 38. The length 56 of the belt portion 38 may be between 15-30 inches and preferably between 18-27 inches. In some embodiments, the belt portion 38 may define a shape other than rectangular. For example, the belt portion 38 may be generally rectangular, irregular, oval, etc. In FIG. 2, the belt portion 38 is generally rectangular with a straight first side 60 and a curved second side 62. As seen, the curved second side 62 forms a maximum width 64 at the center of the belt portion 38. By maximizing the width of the belt 18 at the center of the belt portion 38, the baby carrier 10 may increase comfort by reducing the pressure of the belt 18 on a caregiver's stomach by spreading the force from the infant's weight over a greater area.

As explained above, the baby carrier 10 includes loops 22 that couple the baby carrier 10 to the caregiver's shoulders 24. The loops 22 are not adjustable. That is the size of the loops 22 do not change except in response to stretching or contracting of the fabric. These fixed sized loops 22 reduce the complexity of the baby carrier 10 (i.e., fewer adjustment mechanisms). A simpler baby carrier 10 may facilitate putting on the baby carrier 10 as well as manufacturing.

The loops 22 are formed by coupling a respective first and second single pieces of fabric 66 or 68 (e.g., jersey knit fabric, cotton, polyester, woven fabrics) to the baby support portion 20. The first piece of fabric 66 defines a first end 70 and a second end 72. In some embodiments, the first end 70 couples (e.g., is sewn) to the belt 18, and the second end 72 couples (e.g., is sewn) to the baby support portion 20. In another embodiment, the first end 70 couples to the baby support portion 20. And in still another embodiment, the first end 70 couples to both the baby support portion 20 and the belt 18. The loop 22 on the opposite side of the baby carrier 10 similarly defines a first end 74 and a second end 76. The first end 74 may likewise couple to the belt 18 and/or the baby support portion 20, while the second end 76 couples to the baby support portion 20. In some embodiments, the fabric forming the loops 22 may decrease in width from the first ends 70, 74 to the second ends 72, 76. In other embodiments, the width of the first and second pieces of fabric 66 or 68 may not change between the first ends 70, 74 and the second ends 72, 76. In some embodiments, the loops 22 may partially overlap at their first ends 70, 74. The overlap may be decorative as well as functional. That is the location of the first ends 70, 74 may pull the loops 22 closer to the center of the baby support portion 20, which in turn helps keep the loops 22 on the shoulders 24.

As illustrated, the loops 22 are made out of a single piece of fabric 66, 68, which may increase the structural integrity of the loops 22 and of the baby carrier 10. Coupled to the loops 22 are straps 26 (e.g., adjustment straps). The straps 26 facilitate adjustment of the baby carrier 10 (e.g., lift or lower the baby 14). For example, the caregiver 12 may pull down on the straps 26 to lift and pull the baby 14 closer to the chest 16. By forming loops 22 out of a single piece of fabric (e.g., 66 or 68) and then coupling the straps 26 to the loops 22, the loops 22 may maintain their integrity and still support the baby support portion 20 in the event one or both of the straps 26 separate from the loops 22 during adjustment of the baby carrier 10. In other words, the loops 22 will still support the baby support portion 20 if the straps 26 separate from the loops 22 during use. However, in some embodiments, the loops 22 and/or the straps 26 may include multiple pieces of fabric that are securely coupled together (see FIG. 4).

The length 80 of the straps 26 may be between 25-80 inches and preferably between 30-70 inches, and the length of the loops 22 may be between 20-50 inches and preferably between 25-35 inches to accommodate different caregiver 12 sizes. Furthermore, the length 80 of the straps 26 enables the caregiver 12 to grab the straps 26, adjust the fit of the baby carrier 10, and secure the baby carrier 10 by tying the straps 26 to each other around the caregiver 12.

In some situations, the caregiver 12 may want to carry the baby 14 facing away from the caregiver's chest 16. However, if the baby 14 faces away from the caregiver 12, some or all of the infant's face may be covered by the baby support portion 20. Accordingly, in some embodiments, the baby support portion 20 may include a foldable portion 82. The foldable portion 82 can be folded away from the infant's face and towards the belt 18 (see FIG. 15). To keep the foldable portion 82 in a folded position, the baby support portion 20 may include a button snap system 84 that keeps the foldable portion 82 in the folded position (e.g., attached to the another part of the baby support portion 20). In other embodiments, the button snap system 84 may be a button system, a hook and loop system, etc.

Figure 3:
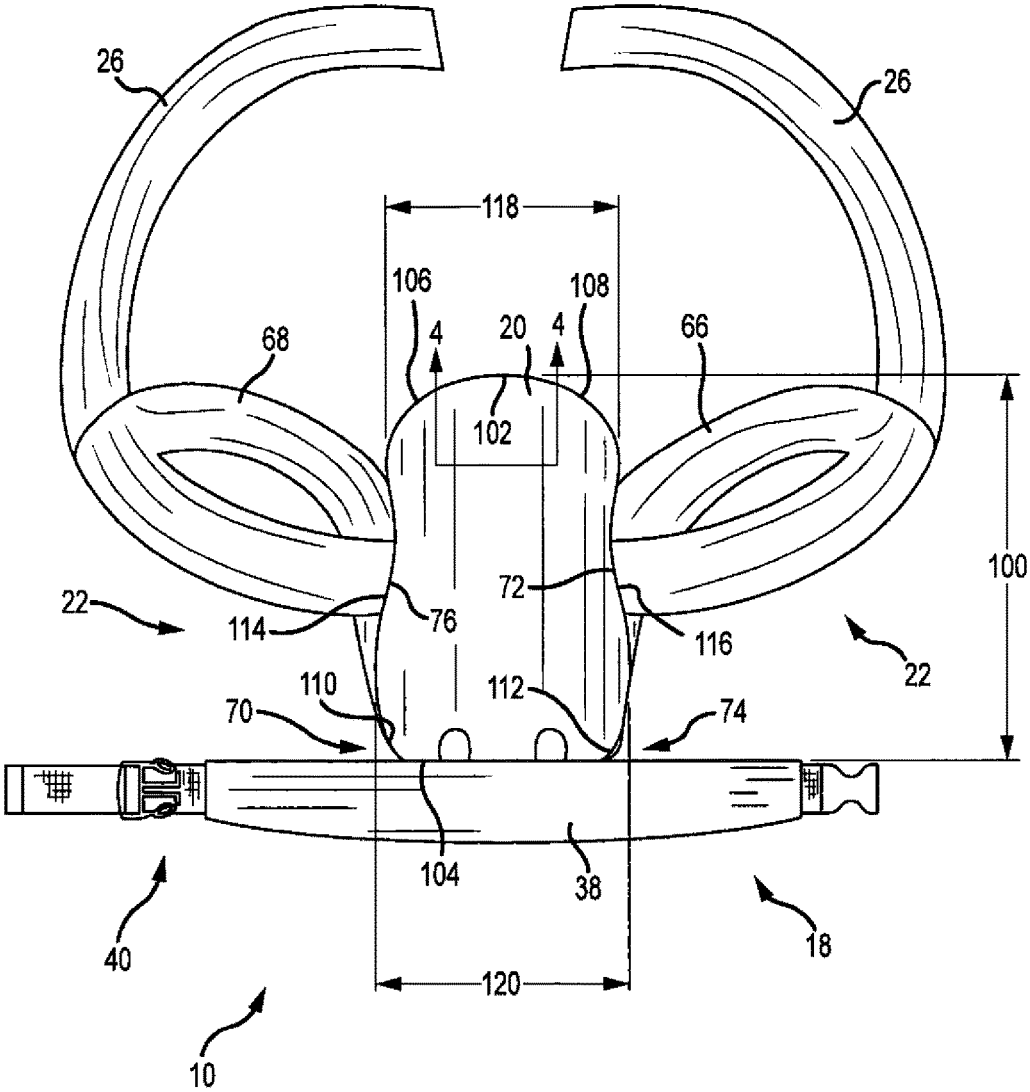
FIG. 3 is rear view of an embodiment of a baby carrier.

FIG. 3 is rear view of an embodiment of a baby carrier 10. As explained above, the first and second pieces of fabric 66 or 68 couple to the baby support portion 20 to form the loops 22. The loops 22 support the baby support portion 20 as well as distribute the weight of the baby 14. The loops 22 may also facilitate retention of the baby 14 in the baby carrier 10. As illustrated, the first ends 72 and 76 of the respective fabrics pieces 66 and 68 couple to the middle of the baby support portion 20. This positions the loops 22 around the middle of the baby 14 when placed in the baby carrier 10, thus retaining the baby 14 within the baby carrier (see FIG. 1).

The baby support portion 20 defines a length 100 between first and second ends 102, 104. The length of the baby support portion 20 may be between 8-30 inches preferably between 12-25 inches. In some embodiments, the first end 102 may be curved in order to increase the length 100 of the baby support portion 20 to support the head and neck of the baby 14, while the curved portions 106 and 108 of the end 102 may increase the ability of the baby 14 to see out of the baby carrier 10 when looking to the side. The second end 104 couples to the belt 18 and may likewise include curved portions 110 and 112. The curved portions 110 and 112 accommodate the legs and hips of the baby 14. This may increase baby comfort and block/reduce hip dysplasia when carried in the baby carrier 10. More specifically, the curved portions 110 and 112 may reduce spreading of the hips and legs of the baby 14 in the baby carrier 10.

Opposing first and second sides 114 and 116 of the baby support portion 20 may also be curved. The curved first and second sides 114, 116 may reduce the amount of fabric in contact with the baby 14 and thus increase breathability of the baby carrier 10. The curved first and second sides 114, 116 may also increase baby comfort by enabling the baby to more easily turn and move their arms. In some embodiments, the first end 102 may define a width 118 that is less than the width 120 of the second end 104. For example, the width 118 of the first end 102 may be 4-25 inches preferably 7-18 inches, and the width 120 may be 5-20 inches and preferably 10-15 inches.

Figure 4:
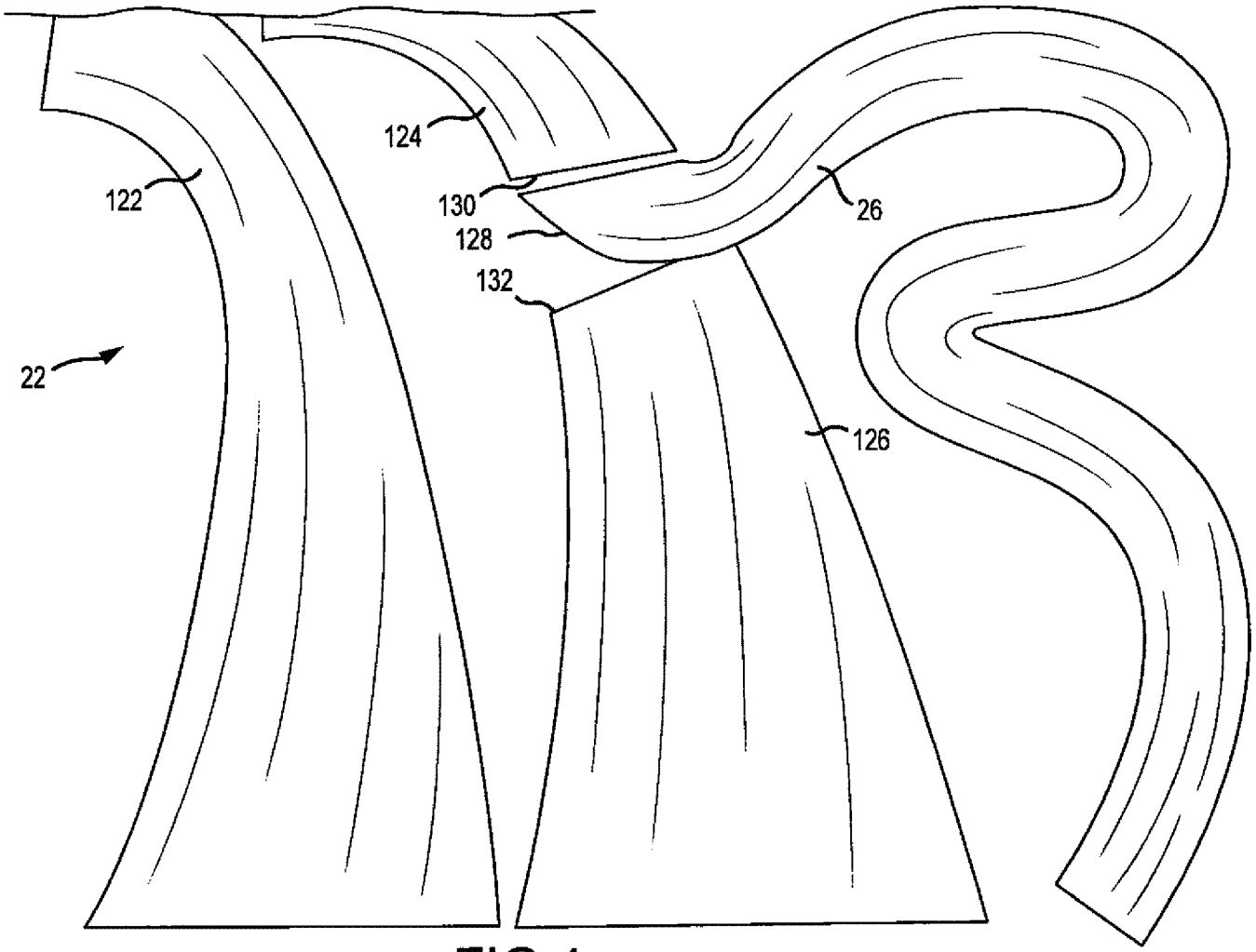
FIG. 4 is a front view of an embodiment of a loop and strap before assembly.

FIG. 4 is a front view of an embodiment of a loop 22 before assembly. As explained above, the loop 22 may be made out of multiple pieces or out of a single piece of fabric. For example, the loops 22 may include a one-piece lining 122, a first outer facing piece 124, and a second outer facing piece 126. During assembly a strap end 128 of the strap 26 is coupled (e.g., sewn) to an end 130 of the first outer facing piece 124 and to an end 132 of the second outer facing piece 126. The first and second outer facing pieces 124, 126 are then coupled (e.g., sewn) to the liner 122 to form the loop 22 with the attached strap 26. This arrangement may increase the structural integrity of the baby carrier 10. For example, if the connection between the loops 22 and the straps 26 weakens, the straps 26 separate from the loops 22 leaving the loops 22 intact. More specifically, the straps 26 may separate from the first and/or second outer facing pieces 124, 126 while the liner 122 of the loop 22 remains intact to support the baby support portion 20.

Figure 5:
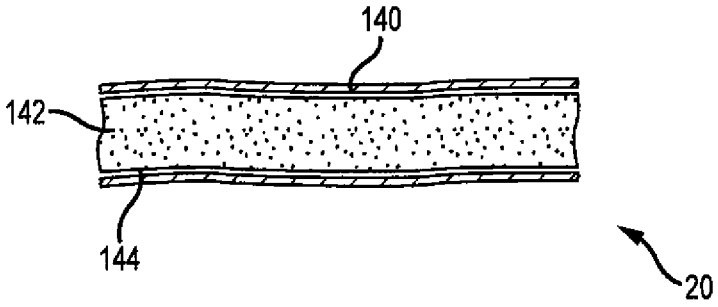
FIG. 5 is a cross-sectional view of an embodiment of a baby support portion.

FIG. 5 is a cross-sectional view of an embodiment of a baby support portion 20 of the baby carrier 10. As illustrated, the baby support portion 20 may include layers (e.g., 1, 2, 3, 4, 5). For example, the baby support portion 20 may include three layers: a first layer 140, a second layer 142, and a third layer 144. The first and third layers 140 and 144 may be fabric layers (e.g., jersey knit fabric), while the second layer 142 may be a fill layer (e.g., open cell foam, batting, fiber fill, foam, memory foam) that may insulate and/or increase the comfort of the baby 14. The first and third layers 140, 144 may be included for aesthetic purposes and to protect the second layer 142 from wear (e.g., washings and other normal wear and tear). In some embodiments, the loops 22 may also include multiple layers (e.g., 1, 2, 3, 4, 5) to increase the comfort of the caregiver 12 while wearing the baby carrier 10. For example, the loops 22 may include multiple layers at point where the loops 22 rest on the caregiver's shoulders 24.

Figure 6:
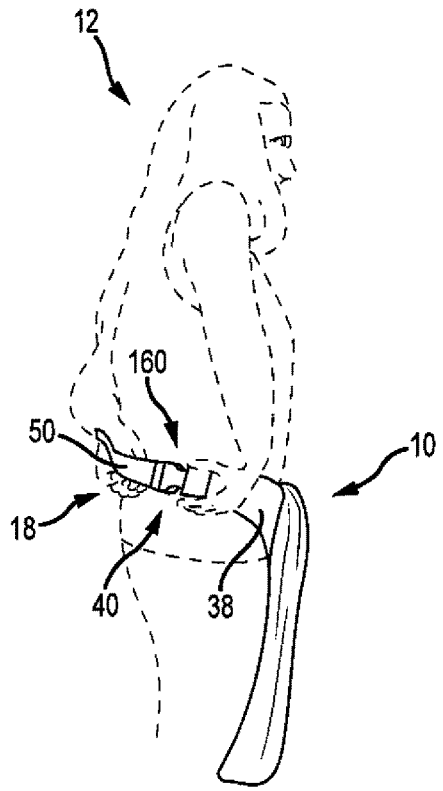
FIG. 6 is a side view of a caregiver coupling a belt of the baby carrier around the waist.

FIGS. 6-15 illustrate a method of putting on and adjusting the baby carrier 10. FIG. 6 is a side view of a caregiver 12 coupling the belt 18 of the baby carrier 10 around the caregiver's waist 160. As explained above, the belt 18 may include a buckle system 40 with a male connector 46 and a female connector 48 that couple together to secure the belt 18 around the waist 160 of the caregiver 12. After connecting the male connector 46 to the female connector 48, the caregiver 12 may adjust the belt 18 for comfort by tightening or loosening the adjustable strap 50.

Figure 7:
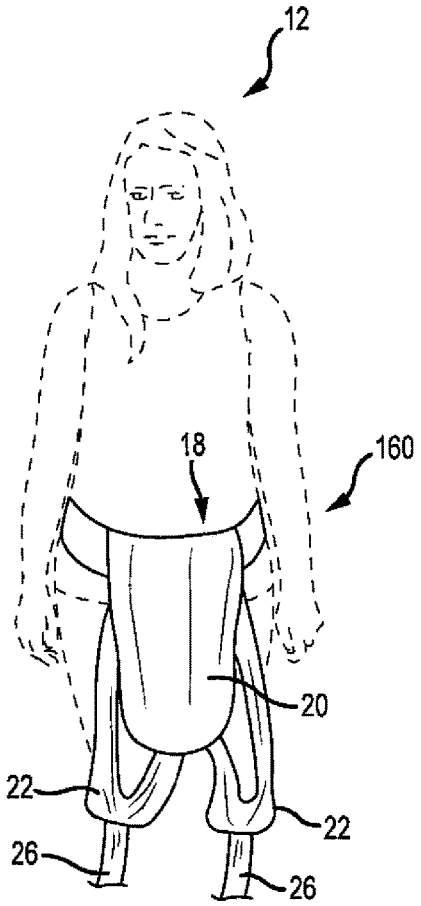
FIG. 7 is a front view of a caregiver with the baby carrier coupled around the waist.

FIG. 7 is a front view of a caregiver 12 with the baby carrier 10 coupled around the waist 160. After adjusting the belt 18, the caregiver 12 rotates the baby carrier 10 so that the baby support portion 20, the loops 22, and the straps 26 are in front of the caregiver 12.

Figure 8:
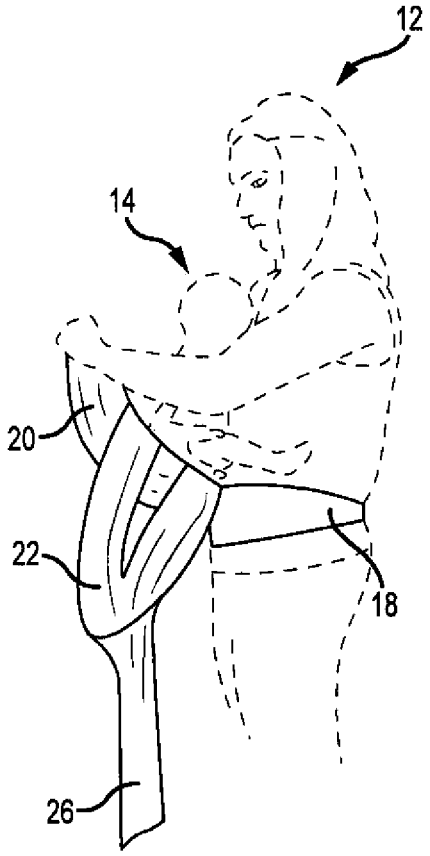
FIG. 8 is a side view of a caregiver placing a baby in the baby carrier.
Figure 9:
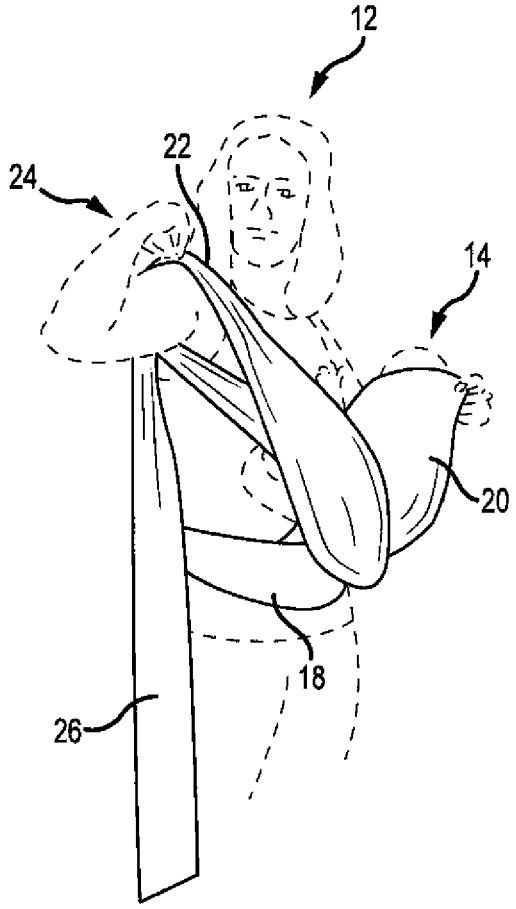
FIG. 9 is a perspective view of a caregiver with a first loop of the baby carrier on a first shoulder.
Figure 10:
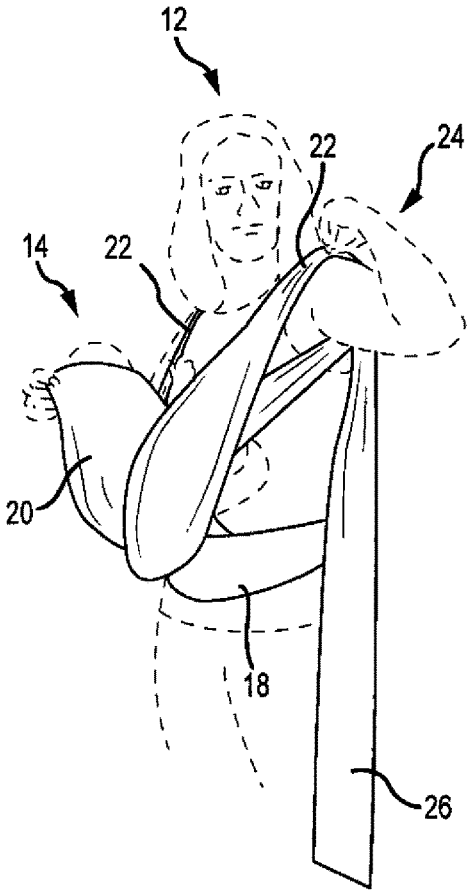
FIG. 10 is a perspective view of a caregiver with a second loop of the baby carrier on a second shoulder.

The caregiver 12 then grabs and lifts the baby support portion 20 and places the baby 14 in the baby support portion 20, as illustrated in FIG. 8. While supporting the baby 14, the caregiver 12 places one of the loops 22 and straps 26 over one of the shoulders, as illustrated in FIG. 9. The caregiver 12 may then switch hands to support the baby 14. After switching hands, the caregiver places the other loop 22 and strap 26 over the opposite shoulder 24, as illustrated FIG. 10. In this position, the baby 14 is secured and supported by the baby carrier 10.

Figure 11:
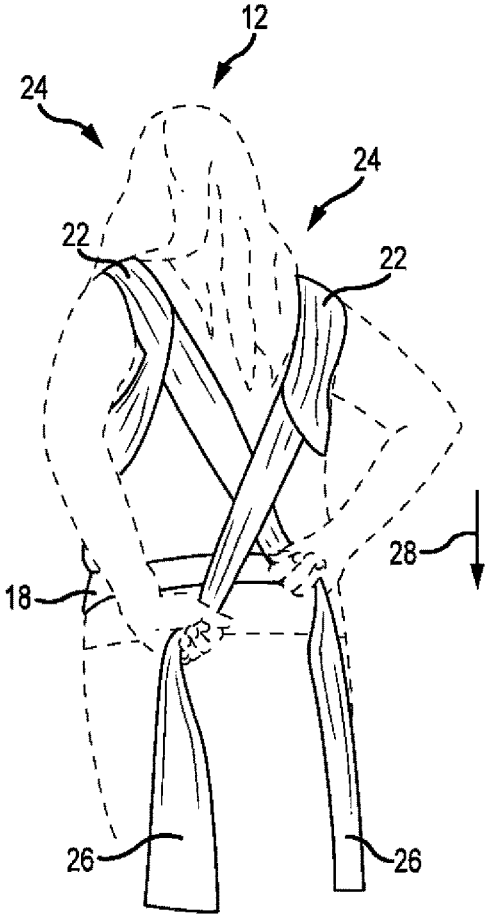
FIG. 11 is a rear perspective view of a caregiver crossing and pulling a first strap coupled to the first loop and a second strap coupled to a second loop.

FIG. 11 is a rear perspective view of a caregiver 12 crossing and pulling the straps 26. As explained above, the baby carrier 10 may be adjusted to increase the comfort of the baby 14 and caregiver 12. To adjust the baby carrier 10, the caregiver 12 crosses and pulls down on the straps 26 in direction 28. The downward force rotates the loops 22 around the shoulders 24, which lifts and pulls the baby support portion 20 closer to the caregiver's chest 16. In some embodiments, the loops 22 and the straps 26 are made out of the separate pieces of fabric. The straps 26 are coupled to the loops 22 by sewing, etc. This arrangement may increase the structural integrity of the baby carrier 10. For example, if the connection between the loops and the straps 26 weakens, the straps 26 separate from the loops 22. The loops 22 therefore remain intact and continue to support the baby support portion 20, and thus the baby 14.

Figure 12:
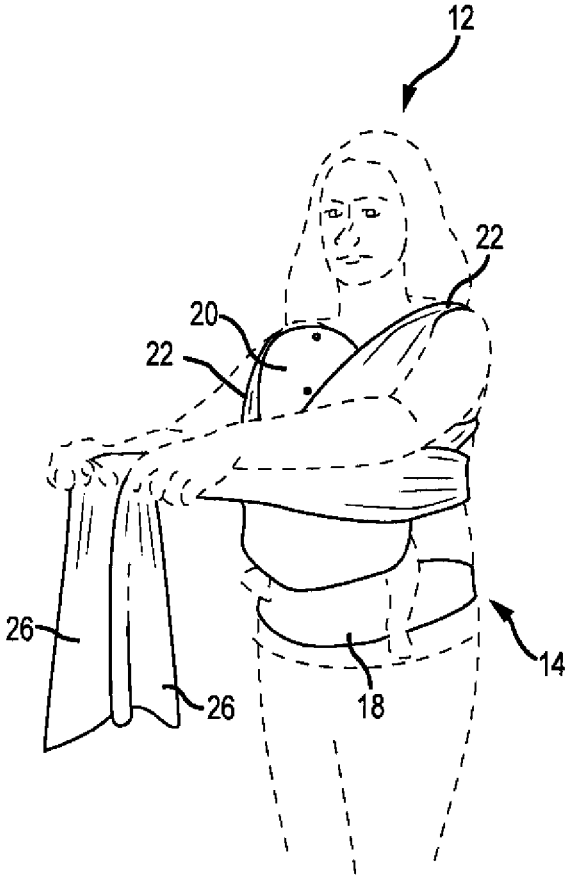
FIG. 12 is a front perspective view of a caregiver pulling the first and second straps in front of the caregiver.
Figure 13:
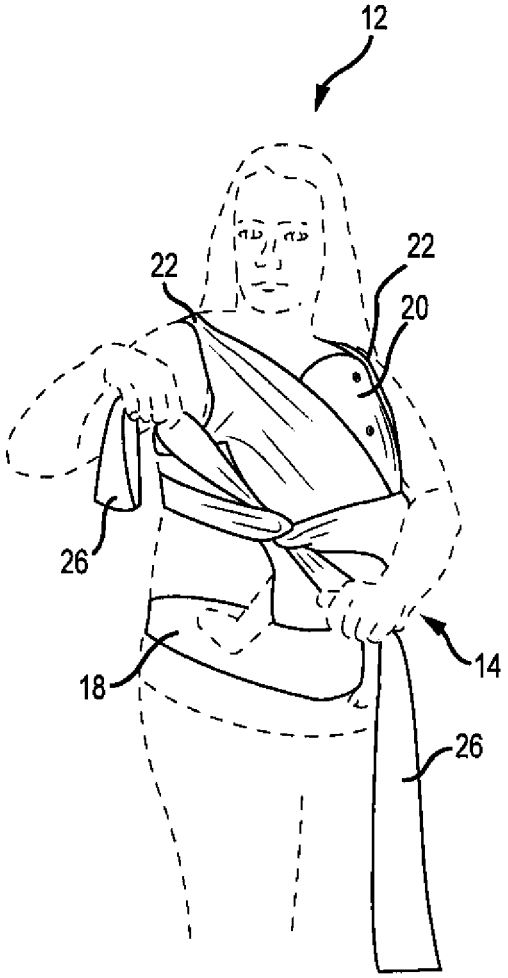
FIG. 13 is a front perspective view of a caregiver tying a knot with the first and second straps.
Figure 14:
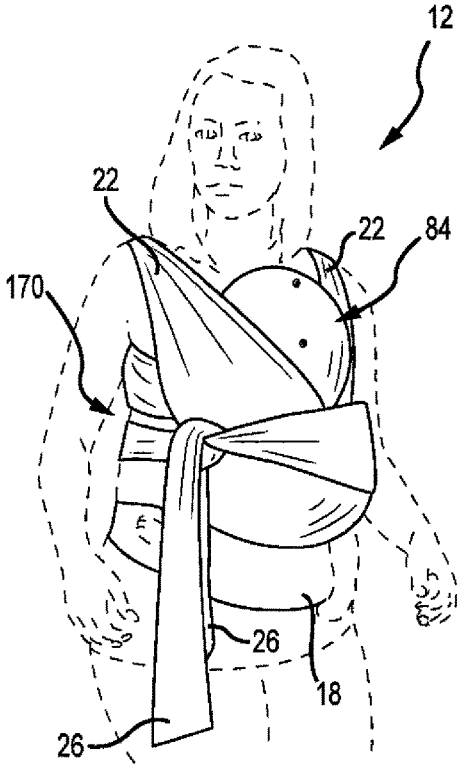
FIG. 14 is a perspective view of a caregiver with the baby carrier.

After adjusting the position of the baby 14, the straps 26 are pulled to the front of the caregiver 12 and past the baby support portion 20, as illustrated in FIG. 12. The straps 26 are then tied into a knot 170 to secure the baby 14 in the desired position, as illustrated in FIGS. 13-14. Depending on the preference of the caregiver 12, the knot 170 may be tied to either side, over, or below the baby support portion 20.

Figure 15:
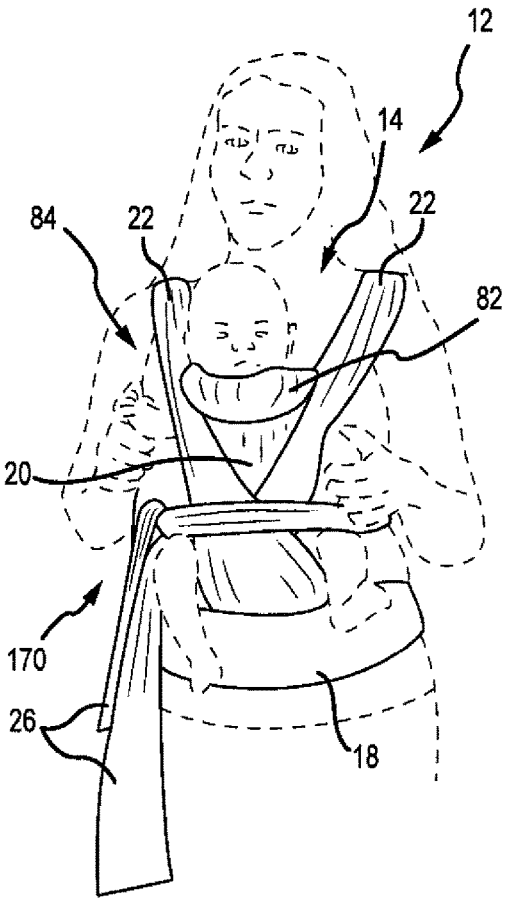
FIG. 15 is a perspective view of a caregiver with the baby facing away from the caregiver in the baby carrier.

As explained above, the baby carrier 10 enables a caregiver 12 to carry the baby 14 facing towards or away from the caregiver 12. FIG. 15 is a perspective view of a caregiver 12 carrying a baby 14 in the baby carrier 10 with the baby 14 facing away from the caregiver 12. In some embodiments, the baby carrier 10 may include a button snap system 84 that enables a foldable portion 82 to be folded down and away from the infant's face.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A baby carrier, comprising:

a belt configured to wrap around a caregiver's waist;

a baby support portion coupled to the belt;

a first loop of fabric configured to rest on a caregiver's first shoulder, the first loop of fabric comprises a first end and a second end, wherein the first end and the second end couple to the baby support portion to define the first loop of fabric;

a first strap of fabric directly coupled to the first loop of fabric;

a second loop of fabric configured to rest on a caregiver's second shoulder, the second loop of fabric comprises a third end and a fourth end, wherein the third end and the fourth end couple to the baby support portion to define the second loop of fabric; and a second strap of fabric directly coupled to the second loop of fabric;

wherein the first strap of fabric and the second strap of fabric are configured to be tied together to secure the first and second loops to the caregiver.

2. The baby carrier of claim 1, wherein the baby support portion comprises a first layer of fabric, a second layer comprising open cell foam, and a third layer of fabric, wherein the second layer couples to and is between the first and third layers of fabric.

3. The baby carrier of claim 1, wherein the first loop, the second loop, the first strap, and the second strap comprise jersey knit fabric.

4. The baby carrier of claim 1, wherein the first loop couples to the belt.

5. The baby carrier of claim 1, wherein the second loop couples to the belt.

6. The baby carrier of claim 1, wherein the belt comprises a buckle.

7. The baby carrier of claim 1, wherein the belt is adjustable.

8. The baby carrier of claim 1, wherein the belt defines a first belt side coupled to the baby support portion and a second belt side opposite the first belt side, wherein the second belt side is curved.

9. The baby carrier of claim 1, wherein the belt comprises a pocket.

10. The baby carrier of claim 1, wherein the baby support portion comprises a button snap system configured to reduce a length of the baby support portion.

11. The baby carrier of claim 1, wherein the first end defines a first width and the second end defines a second width wherein the first width is greater than the second width.

12. A baby carrier, comprising:

a belt configured to wrap around a caregiver's waist;

a baby support portion coupled to the belt;

a first loop of fabric configured to rest on a caregiver's first shoulder, the first loop of fabric comprises a first end and a second end, wherein the first end and the second end couple to the baby support portion to define the first loop of fabric;

a first strap of fabric coupled to the first loop of fabric;

a second loop of fabric configured to rest on a caregiver's second shoulder, the second loop of fabric comprises a third end and a fourth end, wherein the third end and the fourth end couple to the baby support portion to define the second loop of fabric; and a second strap of fabric coupled to the second loop of fabric, wherein:

the first strap of fabric and the second strap of fabric are configured to be tied together to secure the first and second loops to the caregiver; and the first loop, the second loop, the first strap, and the second strap comprise jersey knit fabric.

13. A baby carrier, comprising:

a belt configured to wrap around a caregiver's waist;

a baby support portion coupled to the belt;

a first loop of fabric configured to rest on a caregiver's first shoulder, the first loop of fabric comprises a first end and a second end, wherein the first end and the second end couple to the baby support portion to define the first loop of fabric;

a first strap of fabric coupled to the first loop of fabric;

a second loop of fabric configured to rest on a caregiver's second shoulder, the second loop of fabric comprises a third end and a fourth end, wherein the third end and the fourth end couple to the baby support portion to define the second loop of fabric; and a second strap of fabric coupled to the second loop of fabric, wherein:

the first strap of fabric and the second strap of fabric are configured to be tied together to secure the first and second loops to the caregiver; and the baby support portion comprises a button snap system configured to reduce a length of the baby support portion.

* * * * *